US006220062B1

(12) United States Patent
Enomoto et al.

(10) Patent No.: US 6,220,062 B1
(45) Date of Patent: Apr. 24, 2001

(54) NEEDLE SELECTOR FOR KNITTING MACHINE

(75) Inventors: Takashi Enomoto, Higashimatsuyama; Toshio Watanabe, Saitama-ken; Kazuhisa Watanabe, Fujimi, all of (JP)

(73) Assignee: WAC Data Service Kabushiki Kaisha, Fujimi (JP)

( * ) Notice: Subject to any disclaimer, the term of this patent is extended or adjusted under 35 U.S.C. 154(b) by 0 days.

(21) Appl. No.: 09/486,091

(22) PCT Filed: Jun. 24, 1999

(86) PCT No.: PCT/JP99/03372

§ 371 Date: Feb. 18, 2000

§ 102(e) Date: Feb. 18, 2000

(87) PCT Pub. No.: WO99/67453

PCT Pub. Date: Dec. 29, 1999

(30) Foreign Application Priority Data

Jun. 25, 1998 (JP) ..... 10-193634
Jun. 25, 1998 (JP) ..... 10-193635
Jun. 26, 1998 (JP) ..... 10-195126

(51) Int. Cl.[7] ..... D04B 15/78
(52) U.S. Cl. ..... 66/218
(58) Field of Search ..... 66/8, 215, 218, 66/216, 219, 220, 221

(56) References Cited

U.S. PATENT DOCUMENTS 3,961,501 * 6/1976 Martinetz ..... 66/218
5,027,619 * 7/1991 Saito ..... 66/218
5,533,366 7/1996 Mista et al. .
5,823,015 * 10/1998 Shibata ..... 66/218

FOREIGN PATENT DOCUMENTS

210790 * 2/1987 (GB) ..... 66/218
60-224845 11/1985 (JP) .
401201558 * 8/1989 (JP) ..... 66/218
402259146 * 10/1990 (JP) ..... 66/218
4-36142 8/1992 (JP) .
6-94619 11/1994 (JP) .
7-324262 12/1995 (JP) .
62-28451 2/1997 (JP) .

* cited by examiner

*Primary Examiner*—Danny Worrell
(74) *Attorney, Agent, or Firm*—Frishauf, Holtz, Goodman, Langer & Chick, P.C.

(57) ABSTRACT

A needle selector for knitting machines is provided, which includes a finger actuating device, a power supply means for feeding electric power to the finger actuating device, and power supply terminals for supplying power to the power supply means, wherein said finger actuating device fast and steadily operates piezoelectric bodies 7 including piezoelectric elements by bending them while supporting the piezoelectric bodies 7 at the tip, rear end and a prescribed position between the tip and the rear end, and using a power supply means including of bar-shaped electrodes 28 each including at least two conductive parts with an insulating part in-between, resulting in a substantial reduction in size.

20 Claims, 12 Drawing Sheets

NEEDLE SELECTOR FOR KNITTING MACHINE

BACKGROUND OF THE INVENTION

1. Field of the Invention

The present invention relates to a needle selector for use in knitting machines such as circular knitting machines and weft knitting machines, and more particularly to a needle selector for use in knitting machines in which knitting needles are selected by a piezoelectric drive mechanism.

2. Description of the Related Art

In a knitting machine such as a circular knitting machine or a weft knitting machine, vertical motions of the knitting needle are selected in accordance with a knitting procedure stored in a recording medium, such as a floppy disk or the like, to knit a fabric of the desired texture. Various needle selectors are used for selecting that vertical motions of the knitting needle.

Before describing the needle selector according to the present invention, an outline of needle selection in a knitting machine will be explained with reference to a circular knitting machine schematically illustrated in FIGS. 6A through 6C.

FIG. 6A shows a schematic perspective view of the basic knitting mechanism of a circular knitting machine. As illustrated in FIG. 6A, in the circular knitting machine, knitting needles 2 are arranged slidably in a plurality of vertical grooves (not shown) around the circumference of a knitting cylinder 1, rotating in the direction indicated by an arrow A, the grooves being provided along the lengthwise axis of the knitting cylinder 1. Underneath the knitting needles 2 are usually disposed needle selection jacks 12 to permit contact with the lower parts of the knitting needles 2. On the other hand, underneath the knitting cylinder 1 is statically arranged a cylindrical cam base 15*a,* and on the upper part of that cam base are disposed a plurality of cams 15 of a prescribed shape at prescribed intervals.

The basic principle of knitting is such that each of the knitting needles 2 on the rotating knitting cylinder 1 is thrust upward via the needle selection jack 12; a yarn loop is made by feeding yarn 5, taken up from a yarn bobbin 6 into the hooks of a knitting needle 2 projecting from the upper face of the knitting cylinder 1, as a result; and one stitch is formed by lowering the knitting needle 2 with a known mechanism (not shown). Therefore, a desired fabric can be knit by opting either to give a vertical motion to each knitting needle 2 or to allow advancing to the next step of knitting without forming a stitch. In order to provide such motions to knitting needles, in a knitting machine, needle selection jacks 12 are usually arranged underneath and in contact with knitting needles 2, and the vertical motions of the knitting needles are controlled by using a needle selector 3, operating on the basis of information from a controller 4 with a built-in knit texture memory device, to selectively engage the needle selection jacks 12 with the knitting needles 2.

Next will be described with reference to FIGS. 6B and 6C, illustrating the relationship between the selection jacks and the needle selecting means, an instance in which piezoelectric bodies, which are used according to the present invention, are used as means of knitting needle selection.

A piezoelectric body 47 can be either bent in the way shown in FIG. 6B or in the way shown in FIG. 6C, reverse to the bend illustrated in FIG. 6B, depending on how a voltage is applied. At the tip of the piezoelectric body 47 is arranged a finger 9 linked to it. In FIGS. 6B and 6C, the piezoelectric body 47, the finger 9 and a raising cam 15 are positioned within the frame of a drawing, and the knitting needles 2 and the needle selection jacks 12 move circularly together with the knitting cylinder 1 (not shown) from the top to the bottom of the frame of the drawing (or in the reverse direction). The needle selection jacks 12 can swing pivoting on fulcrums 12*a,* and in the upper part are provided needle selection butts 13 and raising cam butts 14 projecting sideways from the needle selection jacks 12 as illustrated.

When the piezoelectric body 47 is curved as shown in FIG. 6B, the needle selection butts 13 of the needle selection jacks 12, which circularly move, hit the finger 9, and the resultant thrusting of the needle selection jacks 12 in the clockwise direction, pivoting on the fulcrums 12*a,* prevents the raising cam butts 14 from engaging with the raising cam 15 of the needle selection jacks 12. Therefore, the needle selection jacks 12 fail to be thrust upward by the raising cam 15, and at the same time the knitting needles 2 fail to be thrust upward.

When the piezoelectric body 47 is curved as shown in FIG. 6C, the finger 9 at the tip of the piezoelectric body 47 does not hit the needle selection butts 13 of the needle selection jacks 12 which circularly move together with the knitting cylinder 1, and the needle selection jacks 12 remain in the vertical direction with the result that the raising cam butts 14 at the lower ends of the needle selection jacks 12 are thrust upward along the inclined face of the raising cam 15, the knitting needles 2 being thrust upward along with the thrust.

Selective engagement of the needle selection butts 13 of the needle selection jacks 12 with the finger 9 at the tip of the piezoelectric body 47 enables the knitting needles 2 to move upward freely as desired and thereby enables a knit fabric of any desired texture to be knit.

The single most important performance feature for knitting is high productivity, i.e. the possibility to rotate the knitting cylinder faster. In order to turn the knitting cylinder faster, it is necessary to enable the needle selector for controlling upward shifting of the knitting needles to operate faster. For this reason, various fast operating knitting needle selectors have been developed and came into use.

For instance, the same applicant as that for patent on the present invention proposed a needle selector configured to enable a plurality of fingers to be swung by an attractive or repulsive force of an electromagnet (see Japanese Patent Laid-Open No. 60-224845), which is both faster and more compact than conventional needle selectors and moreover can save electric power consumption. Further, the same applicant as that for patent on the present invention proposed a piezoelectric needle selector which causes knitting needles to be selected by operating the fingers themselves by the bending of piezoelectric bodies in place of the above-cited electromagnetic needle selector (see Japanese Patent Laid-Open No. 62-28451), which achieved further advances in speed increase, size reduction and energy saving for needle selectors.

The same applicant as that for patent on the present invention further invented an improved version of the aforementioned piezoelectric needle selector, and filed on Oct. 5, 1988 the Japanese Patent Application No. 63-249967 for that invention, entitled "Needle Selector for Knitting Machines." This was registered as the Japanese Patent No. 1969970, and the corresponding U.S. patent application was registered as U.S. Pat. No. 5,027,619.

This improved piezoelectric needle selector is illustrated in FIG. 7A. To describe this improved version on the basis of claim 1 of Japanese Patent No. 1969970 with reference to FIG. 7A, this is a knitting needle selector in which fingers 9 are arranged to be movable relative to piezoelectric bodies 7 each having a piezoelectric element; electric power is applied to the piezoelectric elements to actuate the fingers 9; this motion of the fingers 9 causes knitting needles of the knitting machine to be selected (via needle selection jacks); and knitting of a fabric of a prescribed pattern texture is made possible. The rear end of each piezoelectric body 7 is characterized by being movably supported via a spherical body, i.e. a rotary body 20, by a support 21 or a concave part 22 of a housing; the tip of the piezoelectric body 7 is characterized by being movably linked via a spherical body, i.e. a rotary body 16, into a U-shaped groove 17 at the rear end of the finger 9; a prescribed position between the rear end and the tip of the piezoelectric body 7 is characterized by being pinched by a rotary body 23 rotatably fitted to a support 34 or the housing, and the finger 9 and the piezoelectric body 7 are characterized by being arranged on a straight line.

The finger 9, as illustrated in FIG. 7A, its intermediate part is borne by a support 10*b* through a pin 8, and this arrangement causes any flexion of the piezoelectric body 9 to move the rear end 9*a* of the finger 9 up and down with the result that the tip 9*b* of the finger 9 projecting through the opening 11 of the support 10*a* is thereby moved up and down and this vertical motion causes the rising motion of the knitting needle 2 to be selected.

The bearing of the piezoelectric body 7 movably in a prescribed position enables the piezoelectric body to freely bend, resulting in a significant increase in the acting speed of the finger 9 and moreover, as it was found, an increase in the shifting quantity of the tip of the finger 9. Furthermore, the use of the piezoelectric body in such a configuration serves to reduce damage to the piezoelectric body and thereby to elongate the useful life of the needle selector.

Therefore, this improved piezoelectric needle selector, as its finger actuating device to swing the finger member is innovatively improved, represents a significant enhancement in needle selecting capability, but the electric power supply means to feed power to the finger actuating device in the needle selector is substantially of the same performance standard as any conventional means. Thus, as shown in FIG. 7B illustrating the overall configuration of the aforementioned improved piezoelectric needle selector, in order to supply electric power to the piezoelectric body 7, electrodes 25 should be provided on the surface of the piezoelectric body 7, and these electrodes 25 are connected by wires 27 to connectors 26 of a connector supporting board B. Though wire connection is a very simple structure, at least two wires 27 are needed per piezoelectric body 7, and moreover wire connection of two electrodes requires a space of a certain size, resulting in large hardware dimensions, the risk of accidental wire disconnection and a high cost of wire fitting. Therefore, this configuration lags behind the remarkable performance improvement of the finger actuating device, and has obstructed further size reduction of needle selectors for knitting machines.

An object of the present invention is to solve the above-noted problems preventing the overall performance improvement and size reduction of needle selectors for knitting machines, as a result of the lag of improvement of power supply means behind the improvement of the finger actuating device itself in known such selectors according to the prior art, and accordingly to provide a needle selector for knitting machines, which is improved in performance and reduced in dimensions.

SUMMARY OF THE INVENTION

According to one aspect of the invention, there is provided a needle selector for knitting machines consisting of a finger actuating device, in which a plurality of piezoelectric bodies are arranged so that the planar surfaces of the piezoelectric bodies overlap one another at prescribed intervals, each of the piezoelectric bodies being movably supported at the tip, in the middle and at the rear end, the piezoelectric bodies are caused to bend by the feeding of electric power and thereby to swing finger members arranged at the tips of the piezoelectric bodies; and a power supply means for feeding electric power to the finger actuating device, characterized in that: the power supply means comprises bar-shaped electrodes each having at least two conductive parts with an insulating part in-between and a slit into which the rear end of one of the piezoelectric bodies can be fitted, and a mechanism for selectively supplying electric power to at least two conductive parts of each of the bar-shaped electrodes, the rear ends of the piezoelectric bodies being inserted into the slits of the bar-shaped electrodes to achieve electrical connection.

According to another aspect of the invention, there is provided a needle selector for knitting machines wherein members for supporting the rear ends of the piezoelectric bodies are formed as bar-shaped electrodes, and each of these bar-shaped electrodes has at least two conductive parts and a slit into which the rear end of a piezoelectric body can fit, so that the piezoelectric body can be fed with at least two kinds of electric power by a simple manipulation of merely inserting the rear end of the piezoelectric body into the slit of this bar-shaped electrode, dispensing with the need, as is the case with the conventional needle selector shown in FIG. 7B, to provide electrodes on piezoelectric bodies and to wiring the connection between the electrodes and the power supply terminals of the needle selector, thereby contributing to reducing the dimensions of the needle selector.

The cross-sectional shape of the bar-shaped electrodes should be preferably, but need not be round, and it may be square or polygonal as long as the rear end of a piezoelectric body is movable relative to the frame of the needle selector. In that case, the corners of the polygonal cross section should preferably be arc-shaped because this would not only smoothen their turning as piezoelectric body rear end supports for the bar-shaped electrodes but also contribute to enhanced durability.

In order to enable the piezoelectric bodies to bend, at least two kinds of electric potentials should be provided as will be described in further detail below with reference to a drawing. Therefore, at least two conductive parts need to be provided via an insulating part in-between in the lengthwise direction of the bar-shaped electrodes. To add, where two conductive parts are used, it is recommended that one of the conductive parts be maintained at a zero electric potential while the other conductive part be fed with a positive potential and a negative potential, alternately.

Or where three conductive parts are used, it is recommended to maintain one at a zero electric potential while the other two conductive parts be fed with a positive potential, alternately. Further, the aforementioned at least two conductive parts should preferably be provided continuously over at least the slit part and the area receiving electric power from the power supply mechanism of the bar-shaped electrodes.

It is also preferable to coat the aforementioned conductive parts with oxidation-resistant metal, such as gold or palladium. It is further preferable to form this coat by plating necessary parts of the bar-shaped electrode bodies made of plastic material. However, the method of coating is not restricted to plating. For instance, parts required to be conducting may be composed of insert members made of oxidation-resistant metal.

Preferably, too, the finger actuating device may comprise a plurality of piezoelectric bodies disposed in parallel; the bar-shaped electrodes may have two conductive parts each; the mechanism for feeding electric power to the conductive parts of the bar-shaped electrodes comprise two power supply plates arranged on the two sides of the plurality of piezoelectric bodies disposed in parallel; and a bar-shaped electrode fitting member having a plurality of concave parts, which keep the two power supply plates at a distance from each other substantially equal to the length of the bar-shaped electrodes and into which the bar-shaped electrodes are inserted; wherein a contact area in contact with both ends of the bar-shaped electrodes for supplying power is provided inside each of the two power supply plates, and power is supplied to the conductive parts via the respective contact areas.

Also preferably, the finger actuating device comprises a plurality of piezoelectric bodies disposed in parallel; the bar-shaped electrodes have three conductive parts each; the mechanism for feeding electric power to the conductive parts of the bar-shaped electrodes comprise two power supply plates arranged on the two sides of the plurality of piezoelectric bodies disposed in parallel; and a bar-shaped electrode fitting member having a plurality of concave parts, which keep the two power supply plates at a distance from each other substantially equal to the length of the bar-shaped electrodes and into which the bar-shaped electrodes are inserted; wherein a contact area in contact with both ends of the bar-shaped electrodes for supplying power is provided inside each of the two power supply plates, power is supplied to the conductive parts on the both ends of the bar-shaped electrodes via the respective contact areas, a groove crossing the concave parts is provided along the lengthwise direction of the bar-shaped electrode fitting member in an area matching the conductive parts in the middle of the bar-shaped electrodes, a conductive layer is provided along the groove, and power is supplied via the conductive layer to the conductive parts in the middle.

It is further preferable to elastically dispose in the contact area a contact member formed by arranging a plurality of conductive thin wires substantially in parallel.

It is also preferable to form the conductive layer by arranging a plurality of conductive thin wires substantially in parallel and disposing them elastically along the groove.

As the piezoelectric bodies, unimorphic piezoelectric bodies can be used. In this case, it is advisable to supply electric power from the upper and lower faces of the piezoelectric bodies.

As the piezoelectric bodies, bimorphic piezoelectric bodies can also be used. In this case, it is advisable to supply electric power from the upper, lower and side faces of the piezoelectric bodies.

When multilayer piezoelectric bodies are used as the piezoelectric bodies, electric power is supplied from the side faces of the piezoelectric bodies.

A needle selector for knitting machines according to the present invention can be effectively used for various circular knitting machines and weft knitting machines including hosiery machines.

BRIEF DESCRIPTION OF THE DRAWINGS

FIG. 1A is a schematic profile, FIG. 1B, a schematic plan, and FIG. 1C, a schematic perspective view , all depicting the structure of bar-shaped electrodes;

FIG. 2A is a schematic profile of a unimorphic piezoelectric body, FIG. 2B, a schematic profile of a bimorphic double electrode type piezoelectric body, and FIG. 2C, a schematic profile of a bimorphic triple electrode type piezoelectric body;

FIGS. 3A and 3B show an example in which conductive parts are produced by plating; FIG. 3A is an axial cross section passing a slit, and FIG. 3B, a lateral cross section on the line B—B in FIG. 3A; FIGS. 3C through FIG. 3E illustrate a bar-shaped electrode using an insert member; FIG. 3C is an axial cross section passing the slit, FIG. 3D, a cross section on the line D—D of FIG. 3C, and FIG. 3E, a cross section on the line E—E of FIG. 3C;

FIG. 4A is a perspective view of the bar-shaped electrode, and FIG. 4B, a cross section on the plane X–Y of FIG. 4A;

FIG. 5A is an exploded perspective view of the power supply means, FIG. 5B, a front view showing the inside of a power supply plate, FIG. 5C, a profile of a bar-shaped electrode fitting member, and FIG. 5D, a front view of the bar-shaped electrode fitting member;

FIG. 6A is a schematic perspective view of the basic knitting mechanism of a circular knitting machine, FIG. 6B, a schematic profile illustrating the relationship among knitting needles, needle selection jacks and a needle selecting means in a state in which a matching knitting needle is not selected, and FIG. 6C, a schematic profile illustrating the relationship among knitting needles, needle selection jacks and a needle selecting means in a state in which a matching knitting needle is selected; FIG. 7A is a middle vertical cross section illustrating the configuration of a piezoelectric body corresponding to a finger actuating device hereunder, and FIG. 7B, a schematic profile of a needle selector provided with three units of the piezoelectric body shown in FIG. 7A.

DETAILED DESCRIPTION OF THE PREFERRED EMBODIMENT

The present invention will be described in detail below with reference to accompanying drawings illustrating preferred embodiments of the needle selector for knitting machines according to the invention.

Figure 1A:
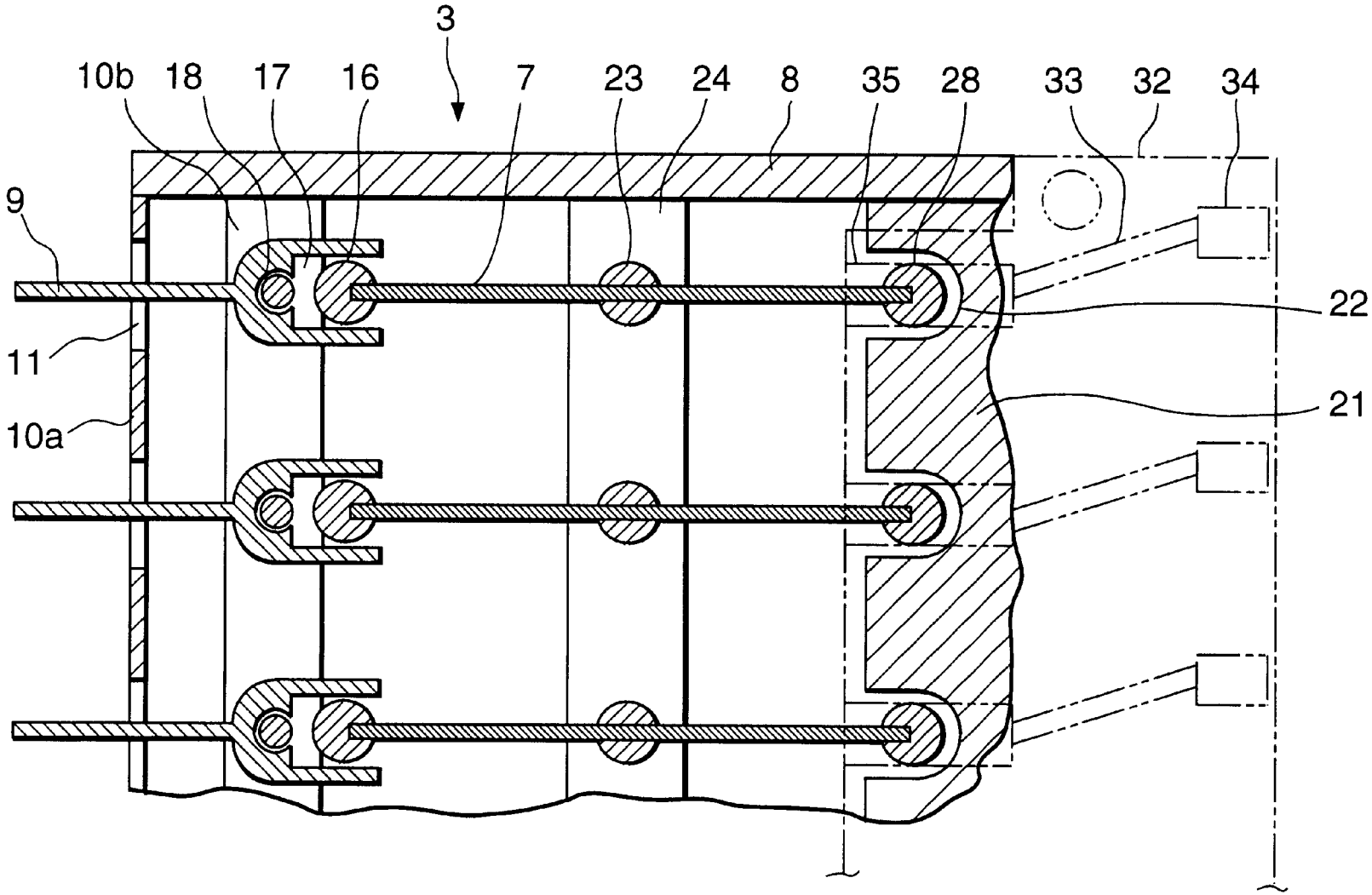
FIGS. 1A through 1C illustrate a structure of one preferred embodiment of a needle selector for knitting machines according to the present invention.
Figure 1B:
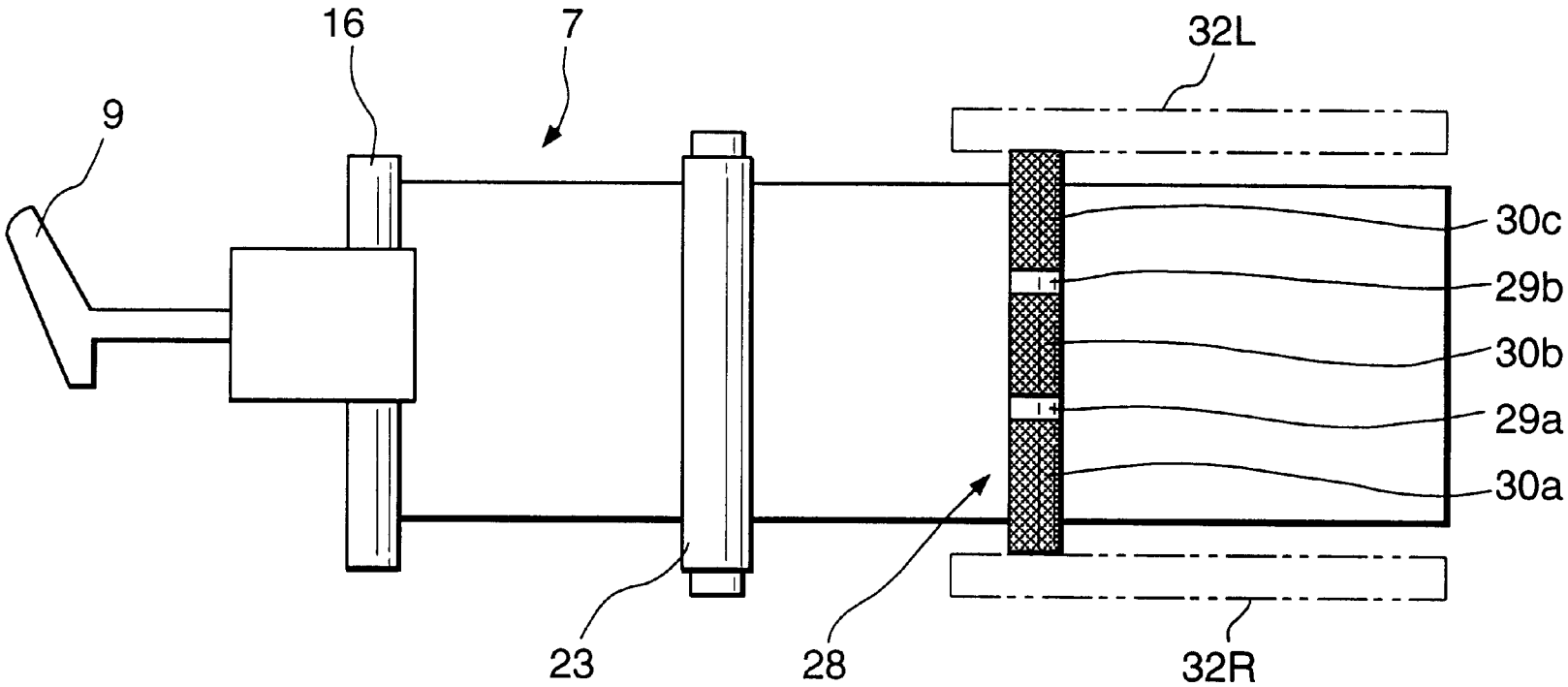
Figure 1C:
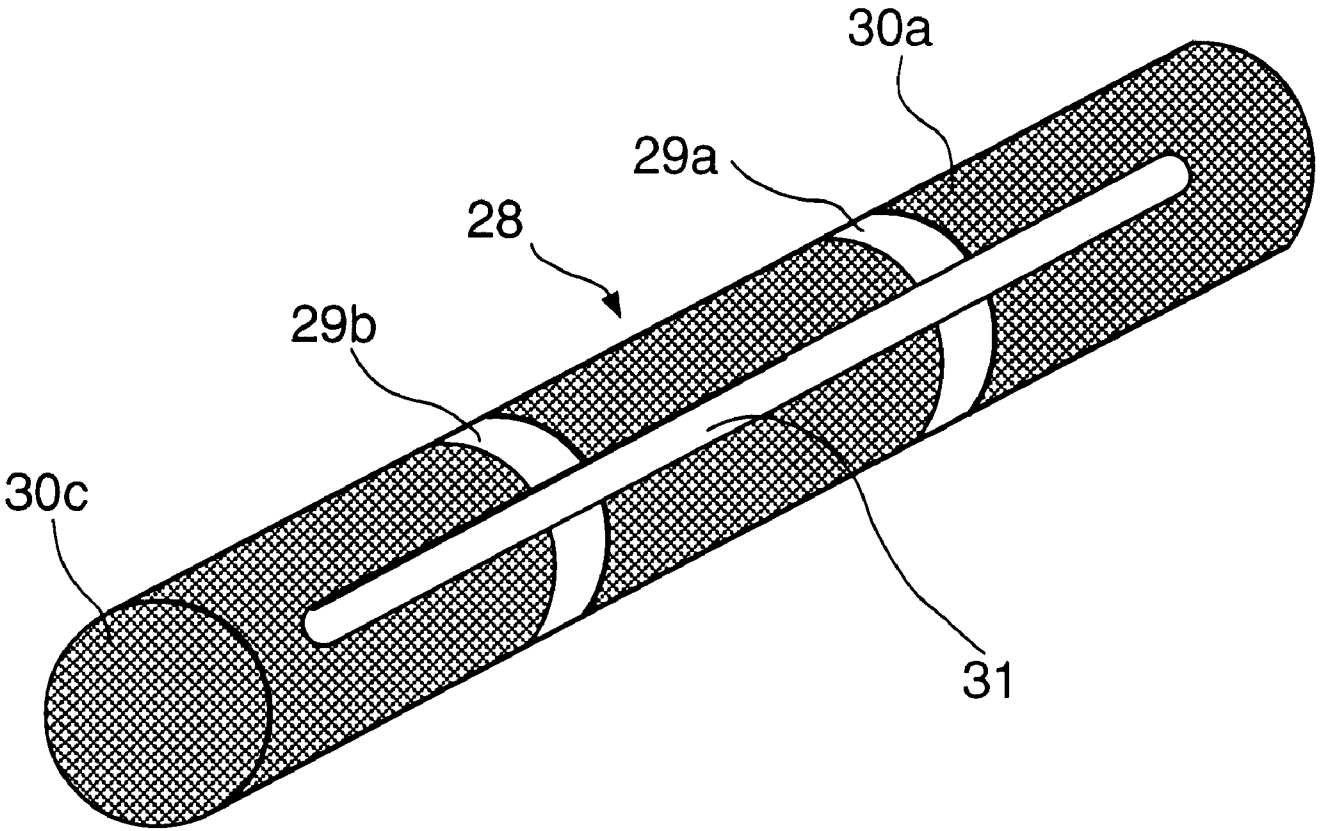

FIG. 1A is a schematic profile of a preferred embodiment of the needle selector for knitting machines, FIG. 1B, a schematic plan of the same, and FIG. 1C, a schematic perspective view of an embodiment of a bar-shaped electrode for use in the needle selector.

Figure 7A:
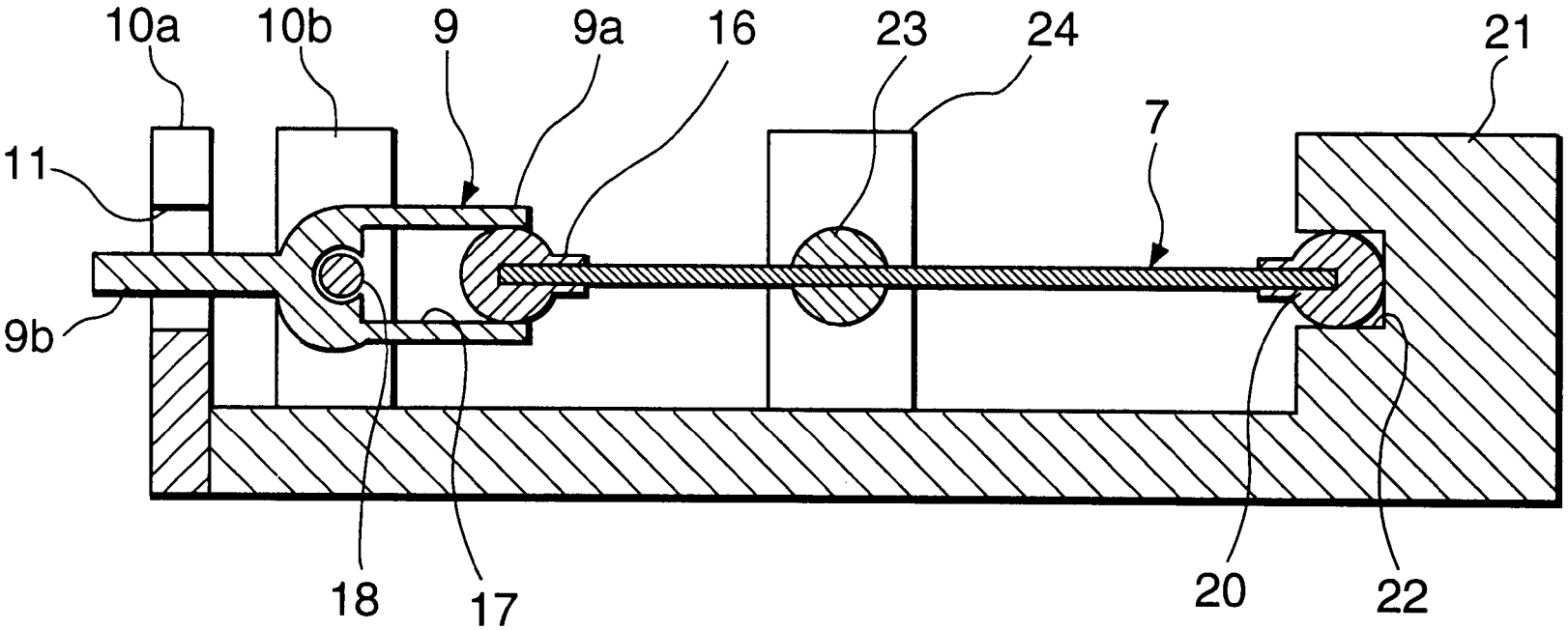
FIGS. 7A and 7B are schematic profiles illustrating a known knitting machine according to the prior art, which constitutes the basis of a needle selector for knitting machines according to the present invention and uses, as does the present invention, a piezoelectric drive mechanism as the needle selecting means.
Figure 7B:
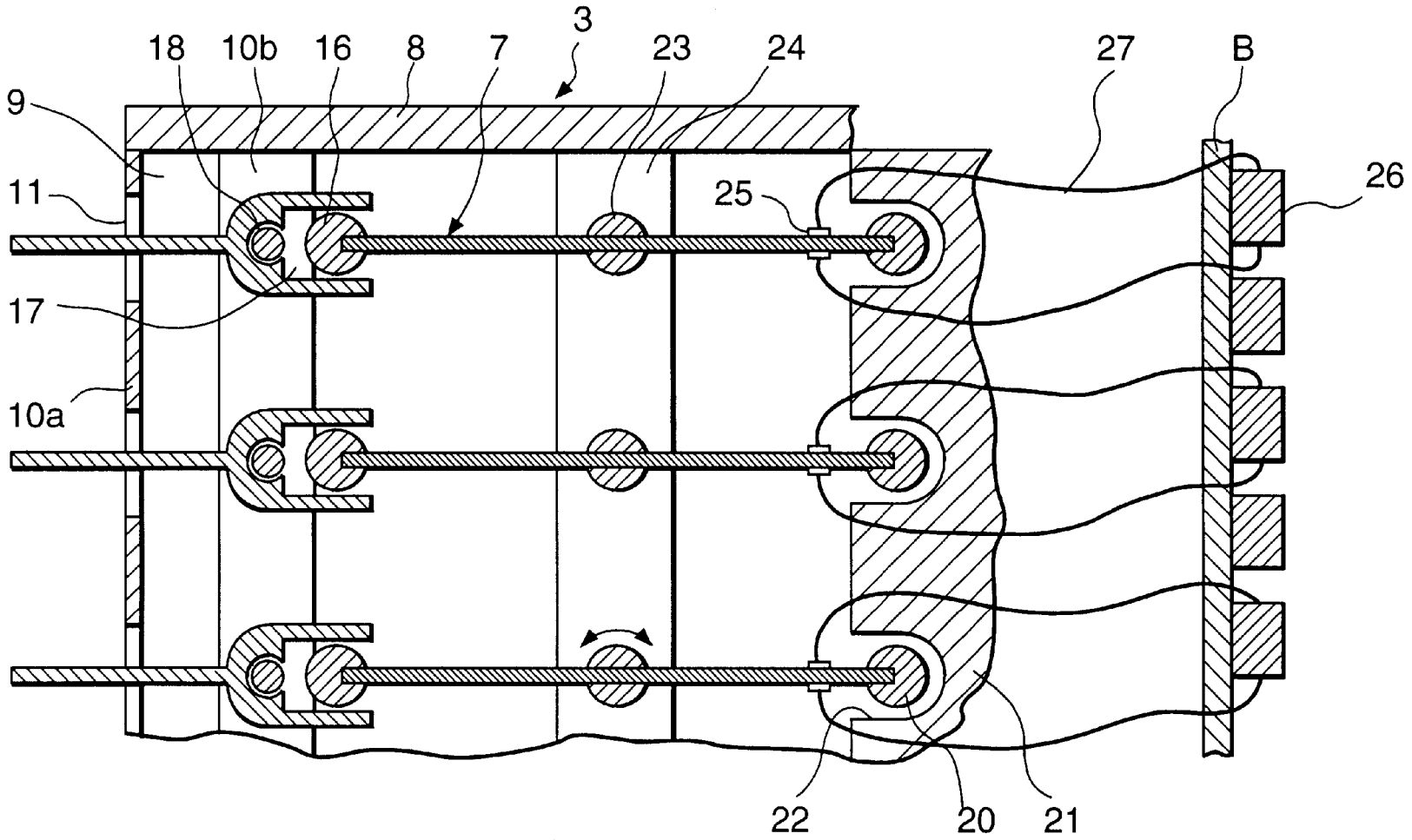

In a needle selector 3 illustrated in FIG. 1A, three piezoelectric bodies 7 are arranged in a horizontal direction at substantially equal vertical intervals. The number of piezoelectric bodies 7 in one needle selector 3, which can be determined as desired according to the type of the knitting machine on which the needle selector 3 is to be mounted, is usually two to eight. At the tip (the left side in FIG. 1A) of each piezoelectric body 7 is fixed a rotational body 16, and to the rear end (the right side in FIG. 1A) of the same is fitted a bar-shaped electrode 28. In further detail, the tip of the piezoelectric body 7 is movably engaged into a U-shaped groove 17 at the rear end of a finger 9 via the fixed rotational body 16, while the rear end of the piezoelectric body 7 is fitted to the bar-shaped electrodes 28 by being fitted into a slit 31 provided into the circumference of the bar-shaped electrodes 28 shown in FIG. 7C in the lengthwise direction. A prescribed position between the tip and the rear end of the piezoelectric body 7 is pinched by a rotational body 23 rotatably fitted to a support 24 or a housing. Further, as shown in FIG. 7A, the finger 9 and the piezoelectric body 7 are arranged on a straight line.

The finger 9, as illustrated in FIG. 1A, is supported in its middle part by a support 10*b* with a pin 18, so that, when the piezoelectric body 7 is bent, that bending motion causes the rear end (the right side in FIG. 1A) of the finger 9 to move up and down with the result that the tip (the left side in FIG. 1A) of the finger 9 projecting through an opening 11 in the support 10*a* moves vertically and thereby a raising motion of a knitting needle 2 is caused to be selected.

Figure 2A:
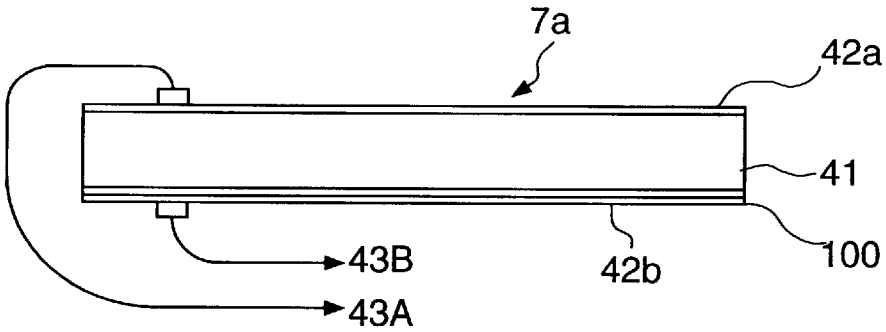
FIGS. 2A through 2C are schematic profiles of a piezoelectric body for use in the needle selector for knitting machines according to the invention.
Figure 6A:
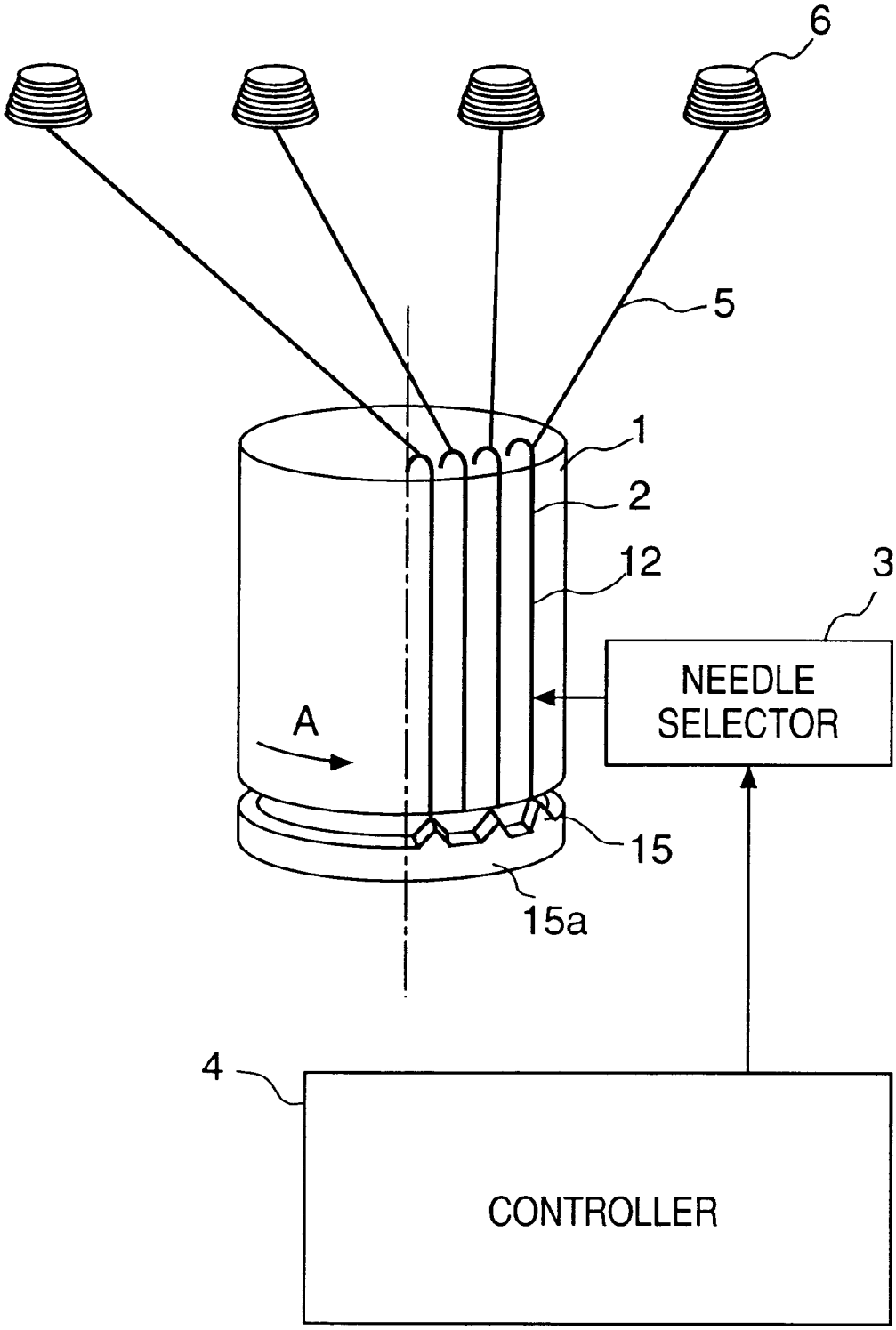
FIGS. 6A through 6C illustrate the knitting mechanism of a known circular knitting machine according to the prior art.
Figure 6B:
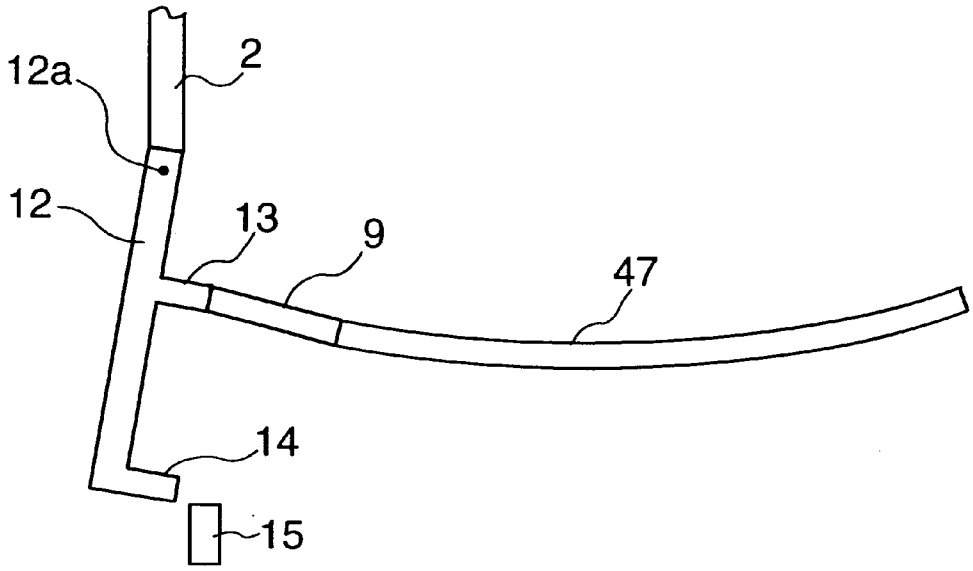
Figure 6C:
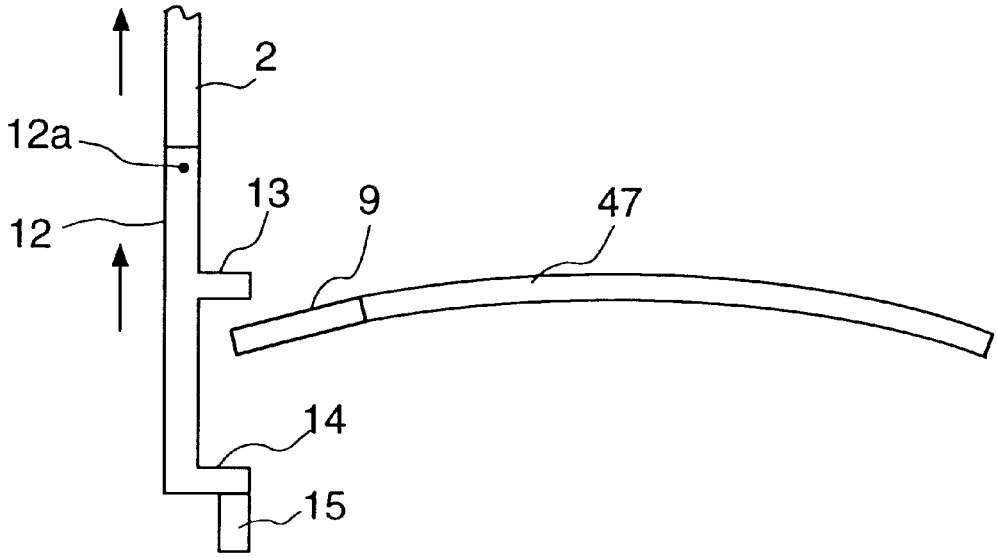

As the piezoelectric bodies 7 for use in the needle selector according to the invention, either unimorphic piezoelectric bodies or bimorphic piezoelectric bodies can be used. FIG. 2A is a vertical cross section illustrating an example of unimorphic piezoelectric body. As shown in FIG. 2A, a unimorphic piezoelectric body 7*a* consists of a ceramic piezoelectric element 41 provided with silver layers 42*a* and 42*b* on the top and bottom faces, and underneath the silver layer 42*b* is stuck a thin metallic plate 100. A conducting circuit extends from the silver layer 42*a* to an electrode 43A and from the thin metallic plate 100 extends a conducting circuit to the electrode 43B.

Where a unimorphic piezoelectric element shown in FIG. 2A is used, for instance by supplying a potential of 0 V to the electrode 43A and a positive or negative voltage to the electrode 43B, either of two states can be achieved in which the piezoelectric element is flexed upward or downward. The states illustrated in FIGS. 6B and 6C can be respectively achieved by these two states of the piezoelectric element.

Figure 2B:
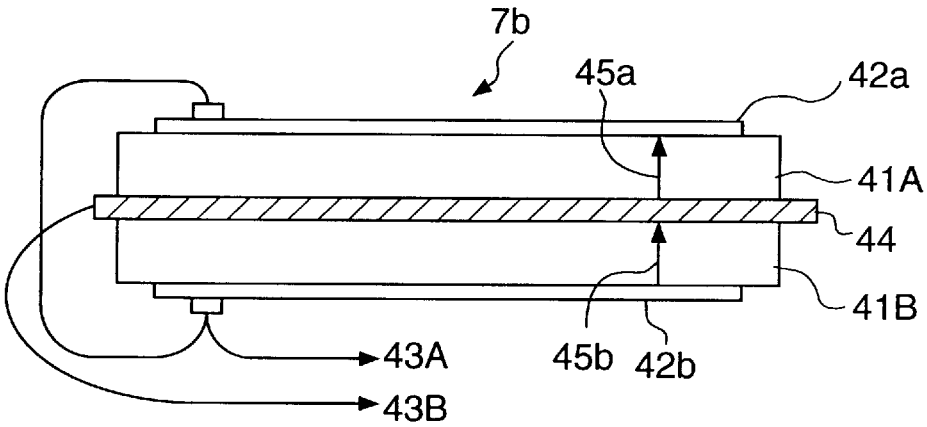
Figure 2C:
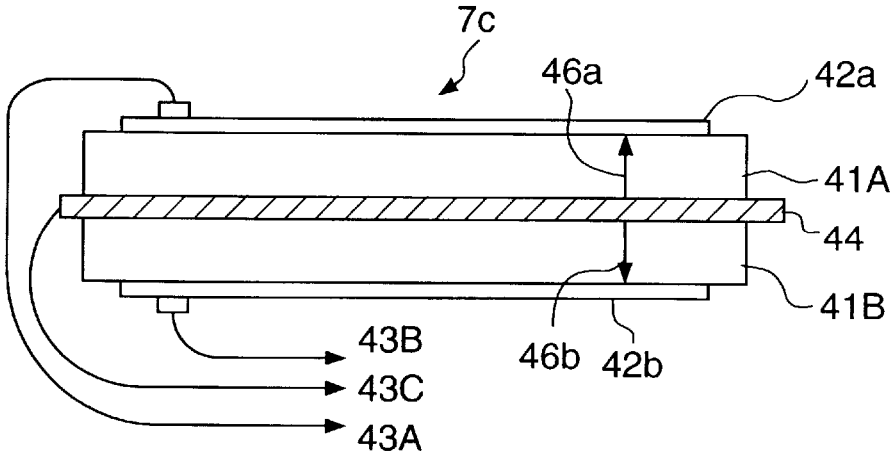

Both FIGS. 2B and 2C are vertical cross sections illustrating on example of a bimorphic piezoelectric body. The bimorphic piezoelectric body consists of a metallic plate 44, known as a shim, and piezoelectric elements 41A and 41B arranged on the two faces of the metallic plate 44, and silver layers 42*a* and 42*b* are provided over the elements 41A and 41B, respectively. The bimorphic piezoelectric body has two versions, i.e. a double electrode type 7*b* shown in FIG. 2B and a triple electrode type 7*c* shown in FIG. 2C, depending on the way of applying a voltage. In the double electrode type 7*b*, conducting circuits extending from the two piezoelectric elements are connected to one electrode 43A, and the shim 44 is connected to the other electrode 43B. In this case, the polarizing directions of ceramic are as indicated by arrows 45*a* and 45*b*. In the double electrodes type 7*b*, if the electrode 43A is kept at a zero potential and a plus potential is provided to the electrode 43B, i.e. to the shim 44, the piezoelectric element 41A will contract and the piezoelectric element 41B will extend. Conversely, if a minus potential is provided to the electrode 43B, the piezoelectric element 41A will extend and the piezoelectric element 41B will contract. As a result, the piezoelectric body 7*b* will bend significantly, though the piezoelectric elements will tend to become depolarized in this case because a voltage is applied in a direction reverse to the polarizing direction of the ceramic.

Where a bimorphic double electrode piezoelectric element shown in FIG. 2B is used, for instance by supplying a potential of 0 V to the electrode 43B and a positive or negative voltage to the electrode 43A, either of two states can be achieved in which the piezoelectric element is flexed upward or downward. The states illustrated in FIGS. 6B and 6C can be respectively achieved by these two states of the piezoelectric element.

In the triple electrode type piezoelectric body 7*c*, as shown in FIG. 2C, the electrode 43C is connected to the conducting circuit extending from the shim 44, the electrode 43A, to the piezoelectric element 41A, and the electrodes 43B, to the piezoelectric element 41B. The electrode 43C is kept at a zero potential. In this case, when the electrode A is electrified and a voltage is applied to the piezoelectric element 41A, the electrode B is not electrified and no voltage is applied to the piezoelectric element 41B. Conversely, when a voltage is applied to the piezoelectric element 41B, no voltage is applied to the piezoelectric element 41A. Therefore, this triple electrode type is bent only half as much as the double electrode type, but it is less likely to be depolarized than the double electrode type piezoelectric body 7*b* because, as indicated by arrows 46*a* and 46*b* in FIG. 2C, the voltage is applied in the polarizing direction of ceramic. For this reason, the bimorphic triple electrode type piezoelectric body 7*b* is extensively as used as a multilayer piezoelectric body.

Thus, a bimorphic triple electrode type piezoelectric element such as the one shown in FIG. 2C, two states of which one is upward flexion and the other is downward flexion of the piezoelectric element can be achieved by, for instance, supplying a potential of 0 V to the electrode 43C and alternately applying a positive voltage to the electrodes 43A and 43B. The two states illustrated in FIGS. 6B and 6C can be respectively achieved by these two states of the piezoelectric element.

FIG. 1C illustrates a bar-shaped conductor of a type preferred for use in the knitting needle selector of this embodiment, and gives a perspective view of the structure of the bar-shaped conductor for use in the triple electrode type piezoelectric body shown in FIG. 2C. The bar-shaped conductor shown in FIG. 1C is configured to have a round cross section. The reason is that a round cross section enables the support of the rear end of a piezoelectric body to be freely varied when the bar-shaped conductor is held by the support of the needle selector to give a bending motion to the piezoelectric body. However, a round cross section is not necessarily required for the bar-shaped conductor, and the cross section may have any shape as long as it can swing smoothly relative to the support of the needle selector.

Since the bar-shaped electrodes 28 of FIG. 1C are a triple electrode type as stated above, three conductive parts 30*a*, 30*b* and 30*c* are arranged in the lengthwise direction in the bar-shaped electrode 28 via insulating parts 29*a* and 29*b*. Further, a slit 31 is provided to accommodate the rear end of the piezoelectric body 7 along the lengthwise direction of the bar-shaped electrode 28.

As will be described below with reference to FIGS. 5A through 5D, when the bar-shaped electrode 28 is inserted into the concave part 22 of the power supply means, its conductive part 30*b* comes into contact with a linear conduction band 37, and the conductive parts 30*a* and 30*b* come into contact with the contact areas 35L and 35R of the power supply plate 32L, 32R to achieve power supply.

Figure 3A:
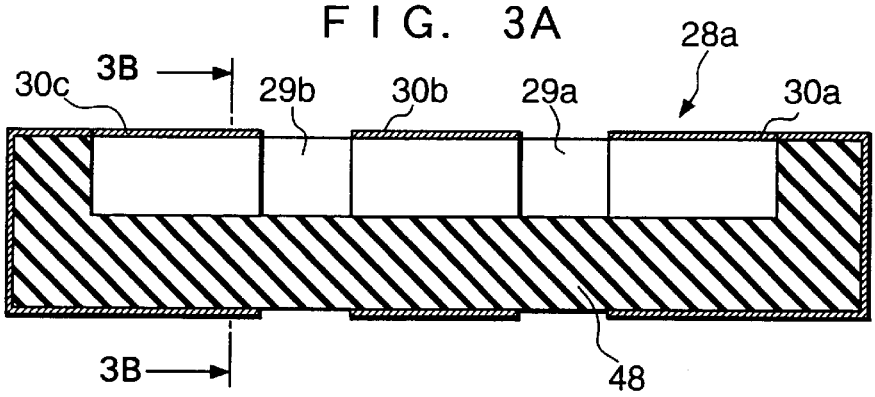
FIGS. 3A through 3E illustrate various modes of forming a bar-shaped electrode for use in the needle selector for knitting machines according to the invention.
Figure 3B:
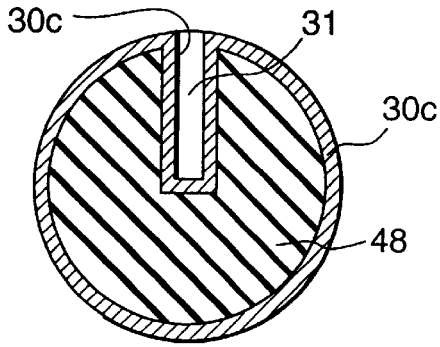
Figure 3C:
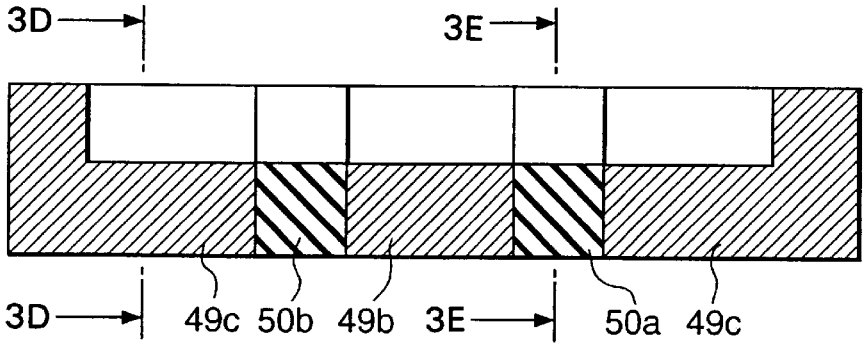

As illustrated in FIG. 3A, the body of the bar-shaped electrode 28 is comprised by molding synthetic resin 48, and its conductive parts are formed by plating the necessary parts of the surface of the synthetic resin body with metal. Preferably, they should be plated with an oxidation-resistant metal, such as gold or palladium. This metallic plating may extend to an end face of the bar-shaped electrode 28 as indicated by 30*c* in FIG. 1C. Three conductive parts are also provided within the slit 31 via insulating parts (see FIG. 3B).

Figure 3D:
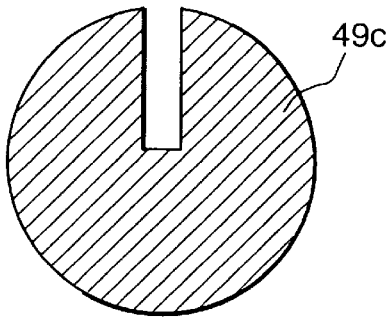
Figure 3E:
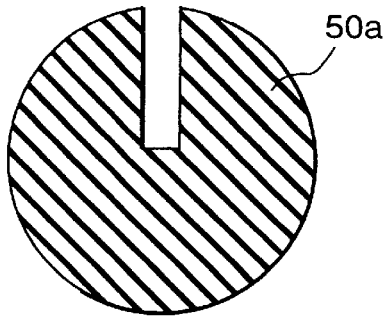

The metallic coat can as well be provided instead of plating. Instead of plating, for instance, a thin metallic foil may be stuck or, in some cases, insulating parts 50*a* and 50*b* (whose cross-sectional shape is shown in FIG. 3E) and metallic conductive members 49*a,* 49*b* and 49*c* (whose cross-sectional shape is shown in FIG. 3D) may be produced as insert members, and combined in a straight line. Combination of these members is so accomplished as to align the slit 31 part straight, using an adhesive for instance.

Further, the piezoelectric body 7 is inserted into the slit 31 of the bar-shaped electrodes 28 as illustrated in FIG. 1. In this state, the conductive parts 30*a,* 30*b* and 30*c* have to be electrically connected to the electrodes 43A, 43C and 43B, respectively, of the piezoelectric body shown in FIG. 2C. Whereas this can be accomplished in various ways, one of them is to coat the surface of the silver layers 42*a* and 42*b* with an insulating layer, and the electrodes to be connected to the silver layers 42*a,* 42*b* and shim 44 are formed in only conductive parts 30*a,* 30*c* and 30*b,* respectively. Incidentally, the electrodes matching the silver layers 42*a,* 42*b* and shim 44 can be taken out of side end faces of the piezoelectric body.

Figure 4A:
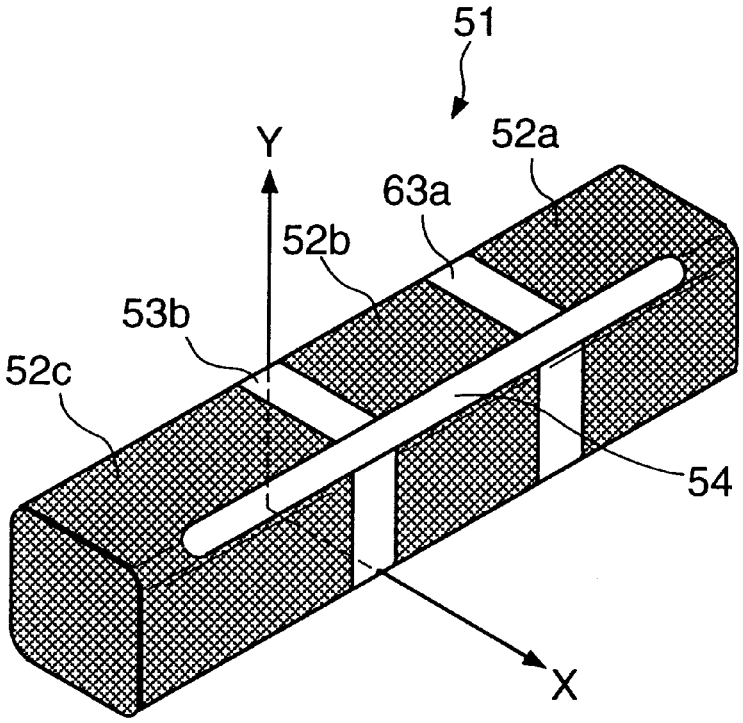
FIGS. 4A and 4B illustrate the structure of another embodiment of a bar-shaped electrode for use in the needle selector for knitting machines according to the invention.
Figure 4B:
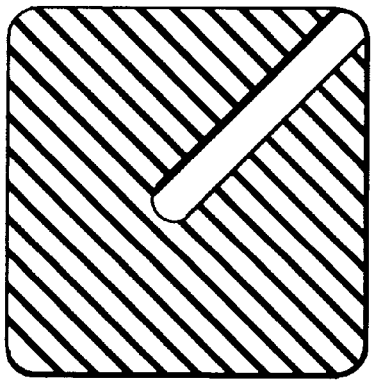

FIG. 4 illustrates an example of bar-shaped electrode 51 whose cross section is square. In this instance, as is the case with the bar-shaped electrodes 28 having a round cross section shown in FIG. 1C, three conductive parts 52*a,* 52*b* and 53*c* are provided via insulating parts 53*a* and 53*b,* and a slit 54 is further disposed. If the cross section is square or polygonal, its corners 55 should preferably be arc-shaped.

Where double electrode type bar-shaped electrodes are used, conductive parts may be provided on the right and left sides of one insulating part.

Further, power supply to cause the piezoelectric body of the finger actuating device to bend may be in either the lengthwise or the widthwise direction of the piezoelectric body. In this embodiment, the bar-shaped electrodes merely happen to be arranged, as a preferable mode of power supply to the piezoelectric body, at the rear end of a piezoelectric body, i.e., on the side opposite the position in which the finger members are arranged. Therefore, by altering the configuration of the power supply means for the finger actuating device, the spherical body 16 in FIG. 1A or the rotational body 23 can as well be adapted to a configuration similar to the bar-shaped electrodes according to the present invention.

Next will be described, with reference to FIGS. 5A through 5D, the power supply means for providing electric power to the finger actuating device and power supply terminals for supplying power to the power supply means in the needle selector for knitting machines according to the invention.

Figure 5A:
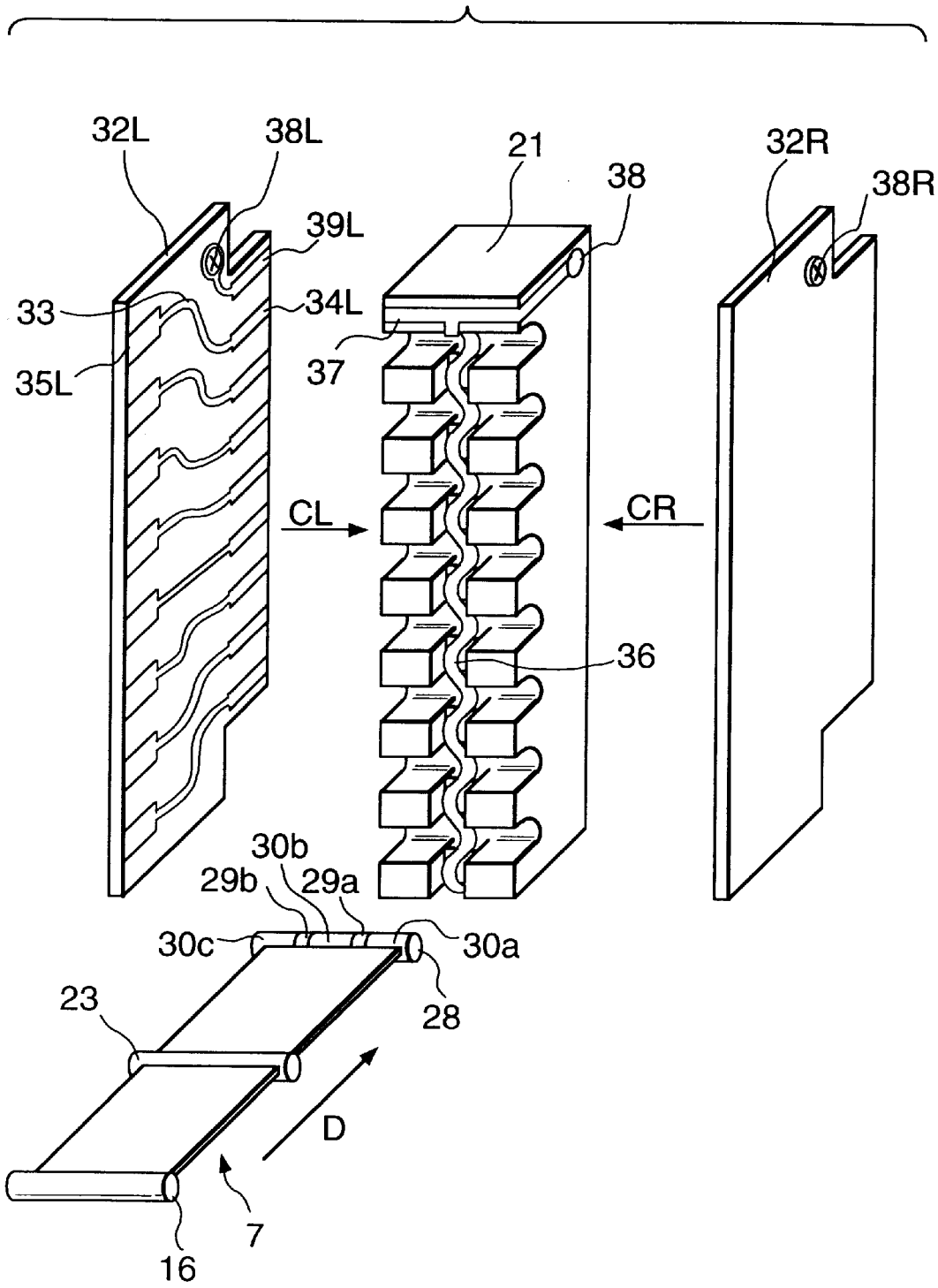
FIGS. 5A through 5D illustrate one example of power supply means for use in the needle selector for knitting machines according to the invention.

FIG. 5A is a schematic diagram illustrating in an exploded view of the power supply means and the power supply terminals as they relate to the bar-shaped electrodes in one embodiment of the needle selector for knitting machines according to the invention. As shown in FIG. 5A, the power supply means for use in the needle selector according to the invention consists of two power supply plates 32L and 32R arranged on the two sides of a plurality of piezoelectric bodies 7 disposed in parallel (only one of them is shown in FIG. 5A), and a bar-shaped electrode fitting member 21 for keeping the two power supply plates 32L and 32R at a distance from each other substantially equal to the width of the bar-shaped electrodes 28 and having a plurality of concave parts 22 into each of which one or another of the plurality of bar-shaped electrodes 28 is to be inserted.

Figure 5B:
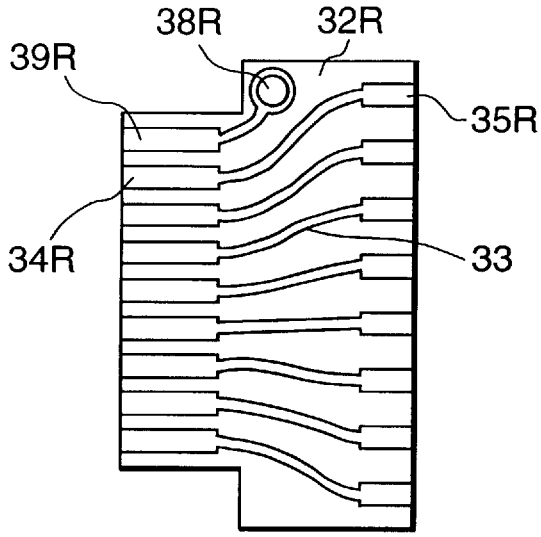
Figure 5C:
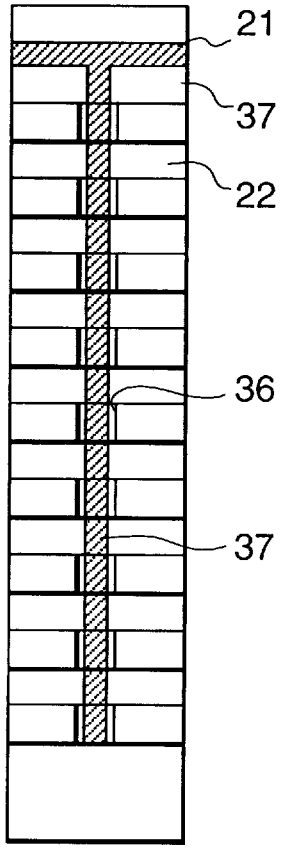

FIG. 5B is a front view illustrating the inside of the power supply plates 32R; FIG. 5C, a profile of the bar-shaped electrode fitting member 21; and FIG. 5D, a front view of the bar-shaped electrode fitting member 21.

Referring to FIG. 5A, which shows an exploded view as mentioned above, by shifting the power supply plate 32L on the left side of FIG. 5A in the direction of an arrow CL to bring it into contact with the bar-shaped electrode fitting member 21 while shifting the power supply plate 32R in the direction of an arrow CR on the right side of the same to bring into contact with the bar-shaped electrode fitting member 21, the power supply means for the needle selector for knitting machines according to the present invention is formed. The two power supply plates 32L and 32R so assembled and the bar-shaped electrode fitting member 21 are fixed into a solid unit with bolts, adhesive or any other suitable means.

At the right end of eight piezoelectric bodies 7 (only one piezoelectric body 7 is shown in FIG. 5A) are fitted the bar-shaped electrodes 28, and the piezoelectric bodies 7 provided with the bar-shaped electrodes 28 in this manner can be supplied with electric power via the bar-shaped electrodes 28 by shifting those bar-shaped electrodes 28 in the direction of an arrow D to insert them into the horizontal grooves 22 provided in the surface of the bar-shaped electrode fitting member 21 on the side toward the viewer of the diagram.

As described with reference to FIG. 1, the triple electrode type bar-shaped electrodes 28 are provided with three conductive parts 30*a,* 30*b* and 30*c* via the two insulating part 29*a* and 29*b*. An instance in which these bar-shaped electrodes 28 are used to maintain the conductive part 30*b* at a potential of zero and a positive potential is alternately provided to the conductive parts 30*a* and 30*c* will be described below.

As illustrated in FIGS. 5A and 5C, on the inner surfaces of the power supply plates 32L and 32R are provided, in contact with the conductive parts 30*a* and 30*c* on the two sides of the bar-shaped electrodes 28, contact areas 35L and 35R to be supplied with power, from which conducting circuits 33 extend to reach power supply terminals 34L and 34R provided at the ends of the power supply plates 32L and 32R. Incidentally, these contact areas 35L and 35R use contact members each consisting of a plurality of conductive thin wires elastically arranged in parallel to maintain satisfactory electrical contact with the conductive parts 30*a* and 30*c* on both end faces of the bar-shaped electrodes 28. In this embodiment, for example, 12 wires of 0.2 mm in diameter arranged in parallel are used as contact members. In the embodiment illustrated in FIG. 5A, as it is provided with eight piezoelectric bodies 7, to each of which electric power is supplied in a different procedure on the basis of information from the controller 4 as described above, one set each of contact areas 35L and 35R, conducting circuit and power supply terminals 34L and 34R need to be provided for each of the piezoelectric bodies 7. While the conductive part 30C of each bar-shaped electrode 28 is provided with power by the set of contact areas, conducting circuit and power supply terminals provided on the power supply plate 32L, the conductive part 30*a* of each bar-shaped electrodes 28 is provided with power by the set of contact areas, conducting circuit and power supply terminals provided on the power supply plate 32R.

Figure 5D:
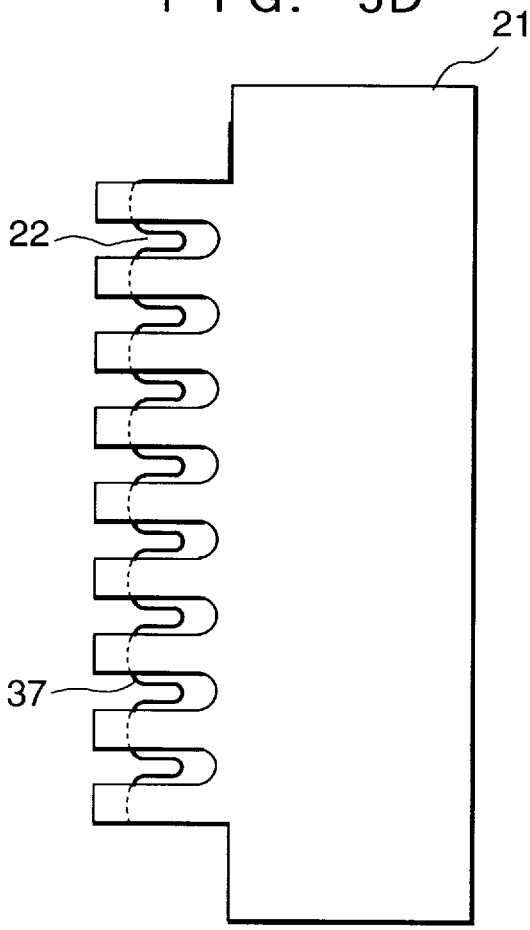

By contrast, as the conductive part 30*b* in the middle of each bar-shaped electrode 28 is maintained at a zero potential, conduction can be accomplished in the same state for the whole piezoelectric body 7. Then, as a preferred embodiment of the invention in this respect, as illustrated in FIGS. 5A, 5C and 5D, a groove 36 is provided in the middle of the bar-shaped electrode fitting member 21 along its lengthwise direction, a linear conduction band 37 is provided at the bottom of that groove 36, this linear conduction band 37 is extended toward the upper part and bent toward the side of the bar-shaped electrode fitting member 21, connected to the contact areas 38L and 38R of the power supply plates 32L and 32R via the contact areas 38, and connected to the power supply terminals 39 of the power supply plates 32L and 32R via conducting circuits similar to the conducting circuit 33.

Incidentally, the linear conduction band 37, like the contact members arranged in the aforementioned contact areas 35L and 35R, consists of a plurality of wires arranged in parallel, and is elastically arranged in the groove 36. Since eight each of the aforementioned power supply terminals 34 and one each of the power supply terminal 39 are arranged close to each other along both edges of the back of the bar-shaped electrode fitting member 21, the supply side for supplying power to these terminals (a zero potential is maintained for the terminal 39) can be integrated into a single connector (illustrated). To add, the foregoing description concerns a case in which triple electrode type piezoelectric bodies are used, and where two electrode type piezoelectric bodies illustrated in FIGS. 2A and 2B are to be used, no conductive part is provided in the middle of the bar-shaped electrodes 28, and the groove 36 in the bar-shaped electrode fitting member 21 may be dispensed with.

The description of the power supply means with reference to FIG. 5 covers only one example, and essentially, as long as a supply means cleared of wire connection is used, the applicability of the invention is not restricted to the illustrated embodiments.

For supplementary information, the external dimensions of the needle selector for knitting machines having a structure disclosed in the Japanese Patent No. 1969970 (referred to below as the prior device), which constitutes the basis of this application for invention, and those of the needle selector according to the present invention (referred to below as the present device) mainly based on improvement of the power supply means are compared in the following table.

| | Width | Length | Height | Volume |
|---|---|---|---|---|
| Prior device (A) | 30 mm | 125 mm | 55 mm | 206 $mm^3$ |
| Present device (B) | 12 mm | 90 mm | 55 mm | 59 $mm^3$ |
| Ratio (B/A) | 40% | 72% | 100% | 29% |

The reduction of the width to as much as 40% means that, for instance 2.5 times as many needle selectors can be accommodated by a circular knitting machine of the same size, resulting in a very significant economic advantage.

Industrial Applicability

Since the needle selector for knitting machines according to the present invention consists of a finger actuating device, having a configuration substantially similar to the finger actuating device under the Japanese Patent No. 1969970 (U.S. counterpart is U.S. Pat. No. 5,029,619) applied for by the same person as the applicant pertaining to this invention, and a power supply means provided with bar-shaped electrodes having a structure characterizing the present invention, the needle selector for knitting machines hereunder can be substantially smaller than any needle selector according to the prior art, allowing many needle selectors to be arranged along the circumference of the knitting cylinder of a circular knitting machine. This has made it possible to provide a much greater number of yarn inlets for a knitting machine than for any conventional knitting machine, and this feature, coupled with the higher speed of the finger actuating device, serves to further enhance the productivity of knitting machines.

What is claimed is:

1. A needle selector for knitting machines comprising a finger actuating device, in which a plurality of piezoelectric bodies are arranged so that planar surfaces of the piezoelectric bodies overlap one another at prescribed intervals, each of the piezoelectric bodies being movably supported at a tip, in a middle and at a rear end thereof, the piezoelectric bodies being caused to bend by application of electric power and thereby to swing finger members arranged at the tips of the piezoelectric bodies, and power supply means for applying electric power to the finger actuating device, wherein:

said power supply means includes bar-shaped electrodes each having at least two conductive parts with an insulating part in-between and a slit into which the rear end of one of said piezoelectric bodies can be fitted, and a mechanism for selectively supplying electric power to at least two conductive parts of each of the bar-shaped electrodes, the rear ends of said piezoelectric bodies being inserted into the slits of said bar-shaped electrodes to achieve electrical connection so that the electric power is applied to each of the piezoelectric bodies via the conductive parts of each of the bar-shaped electrodes.

2. The needle selector for knitting machines, as set forth in claim 1, wherein said bar-shaped electrodes are shaped as round columns, and at least two conductive parts are arranged with an insulating part in-between in the lengthwise direction of the bar-shaped electrodes.

3. The needle selector for knitting machines, as set forth in claim 1, wherein said bar-shaped electrodes have a polygonal cross section, and at least two conductive parts are arranged with an insulating part in-between in the lengthwise direction of the bar-shaped electrodes having the polygonal cross section.

4. The needle selector for knitting machines, as set forth in claim 1, having two of said conductive parts, of which one conductive part is maintained at a zero electric potential and the other conductive part is applied with a positive potential and a negative potential, alternately.

5. The needle selector for knitting machines, as set forth in claim 1, having three of said conductive parts, of which one conductive part is maintained at a zero electric potential and the other two conductive parts are applied with a positive potential, alternately.

6. The needle selector for knitting machines, as set forth in claim 1, wherein said at least two conductive parts are provided continuously over at least the slit part and the area receiving electric power from said power supply mechanism.

7. The needle selector for knitting machines, as set forth in claim 1, wherein said conductive parts are coated with oxidation-resistant metal.

8. The needle selector for knitting machines, as set forth in claim 7, wherein said oxidation-resistant metal is gold.

9. The needle selector for knitting machines, as set forth in claim 7, wherein said oxidation-resistant metal is palladium.

10. The needle selector for knitting machines, as set forth in claim 7, wherein said coat of oxidation-resistant metal is formed by plating necessary parts of the bar-shaped electrode bodies formed of plastic material.

11. A needle selector for knitting machines comprising a finger actuating device, in which a plurality of piezoelectric bodies are arranged so that planar surfaces of the piezoelectric bodies overlap one another at prescribed intervals, each of the piezoelectric bodies being movably supported at a tip, in a middle and at a rear end thereof, the piezoelectric bodies being caused to bend by application of electric power and thereby to swing finger members arranged at the tips of the piezoelectric bodies, and power supply means for applying electric power to the finger actuating device, wherein:

said power supply means includes bar-shaped electrodes each having at least two conductive parts with an insulating part in-between and a slit into which the rear end of one of said piezoelectric bodies can be fitted, and a mechanism for selectively supplying electric power to at least two conductive parts of each of the bar-shaped electrodes, the rear ends of said piezoelectric bodies being inserted into the slits of said bar-shaped electrodes to achieve electrical connection so that the electric power is applied to each of the piezoelectric bodies via the conductive parts of each of the bar-shaped electrodes wherein each of said bar-shaped electrodes have two conductive parts, the mechanism for selectively supplying electric power to each of the conductive parts of said bar-shaped electrodes comprise two power supply plates arranged on two sides of said plurality of piezoelectric bodies, and a bar-shaped electrode fitting member having a plurality of concave parts, which keep the two power supply plates at a distance from each other substantially equal to the length of said bar-shaped electrodes and into which the bar-shaped electrodes are inserted, and wherein a contact area in contact with both ends of the bar-shaped electrodes for supplying power is provided inside each of said two power supply plates, and power is supplied to the conductive parts of said bar-shaped electrodes via the respective contact areas.

12. The needle selector for knitting machines, as set forth in claim 11, wherein contact members each formed by arranging a plurality of electric wires substantially in parallel are disposed elastically.

13. The needle selector for knitting machines, as set forth in claim 1, wherein said bar-shaped electrodes have three conductive parts each, one each at two ends and in the middle; the mechanism for feeding electric power to the conductive parts of said bar-shaped electrodes comprise two power supply plates arranged on the two sides of said plurality of piezoelectric bodies; and a bar-shaped electrode fitting member having a plurality of concave parts, which keep the two power supply plates at a distance from each other substantially equal to the length of said bar-shaped electrodes and into which the bar-shaped electrodes are inserted; wherein a contact area in contact with both ends of the bar-shaped electrodes for supplying power is provided inside each of said two power supply plates, power is supplied to the conductive parts of said bar-shaped electrodes via the respective contact areas, a groove crossing said concave parts is provided along the lengthwise direction of said bar-shaped electrode fitting member in an area matching the conductive parts in the middle of said bar-shaped electrodes, a conductive layer is provided along the groove, and power is supplied to the conductive layer of the middle part of said bar-shaped electrodes via the conductive layer.

14. The needle selector for knitting machines, as set forth in claim 13, wherein contact members each formed by arranging a plurality of electric wires substantially in parallel are disposed elastically.

15. The needle selector for knitting machines, as set forth in claim 13, wherein conductive layer formed by arranging a plurality of electric wires substantially in parallel is disposed elastically along the groove.

16. The needle selector for knitting machines, as set forth in claim 1, wherein unimorphic piezoelectric bodies are used as said piezoelectric bodies and electric power is supplied from upper and lower faces of said unimorphic piezoelectric bodies.

17. The needle selector for knitting machines, as set forth in claim 1, wherein bimorphic piezoelectric bodies are used as said piezoelectric bodies and electric power is supplied from the upper, lower and side faces of said bimorphic piezoelectric bodies.

18. The needle selector for knitting machines, as set forth in claim 1, wherein said piezoelectric bodies are multilayer piezoelectric bodies, and wherein power is supplied from side faces of said multilayer piezoelectric bodies.

19. A circular knitting machine mounted with a needle selector for knitting machines as claimed in claim 1.

20. A weft knitting machine mounted with a needle selector for knitting machines as claimed in claim 1.

* * * * *